United States Patent [19]

Metschnabl et al.

[11] 4,006,811

[45] Feb. 8, 1977

[54] REVERSING DEVICE FOR THE LONGITUDINAL ADVANCE OF A RIBBON OF TYPE PRINTERS

[75] Inventors: Andreas Metschnabl, Nurnberg; Gottfried Burkhardt, Winkelhaid, both of Germany

[73] Assignee: D I E H L datensysteme GmbH, Nurnberg, Germany

[22] Filed: Dec. 2, 1975

[21] Appl. No.: 636,912

[30] Foreign Application Priority Data

Dec. 3, 1974 Germany ..... 2456989

[52] U.S. Cl. ..... 197/161; 74/20; 197/164

[51] Int. Cl.[2] ..... B41J 33/512

[58] Field of Search ..... 197/160, 161, 164; 74/2, 20, 21

[56] References Cited

UNITED STATES PATENTS

| | | | |
|---|---|---|---|
| 1,165,546 | 12/1915 | Sholes | 197/160 |
| 1,439,058 | 12/1922 | Baeseler | 197/162 |
| 1,702,938 | 2/1929 | Garbell | 197/161 |
| 1,825,705 | 10/1931 | Seidelinger | 197/160 |
| 1,950,725 | 3/1934 | Garbell | 197/161 |
| 2,742,132 | 4/1956 | Anderson | 197/160 |
| 2,978,089 | 4/1961 | Dodge et al. | 197/161 |

*Primary Examiner*—Edgar S. Burr
*Assistant Examiner*—Paul T. Sewell
*Attorney, Agent, or Firm*—Walter Becker

[57] ABSTRACT

A reversing device for the longitudinal advance of a ribbon on type printers for the alternating drive of two reels by means of a feed shaft which is selectively drivingly connectable to one of the gears respectively connected to the reels for the ribbon. The drive from the respective winding-up reel to the respective unwinding reel is reversible by a feeler lever controlled by the ribbon coil, by a second lever adapted to be controlled by the feeler lever while being displaceably guided by an interengaging pivot-slot arrangement, and by an eccentric rotating in synchronism with the feed shaft. The eccentric is arranged on a stationarily journalled drive shaft continuously drivingly connected to the feed shaft. The displaceable second lever is designed as a pendulum lever displaceable about perpendicularly to the longitudinal axis of the feed shaft and is pivotal about parallelly to the longitudinal axis of the feed shaft. The pendulum lever comprises a pin engaged by the feeler lever for the longitudinal displacement thereof and also comprises two abutments which for purposes of reversing the transporting direction selectively cooperate with one of two abutments on the feed shaft for an axial displacement thereof.

2 Claims, 2 Drawing Figures

Fig. 1
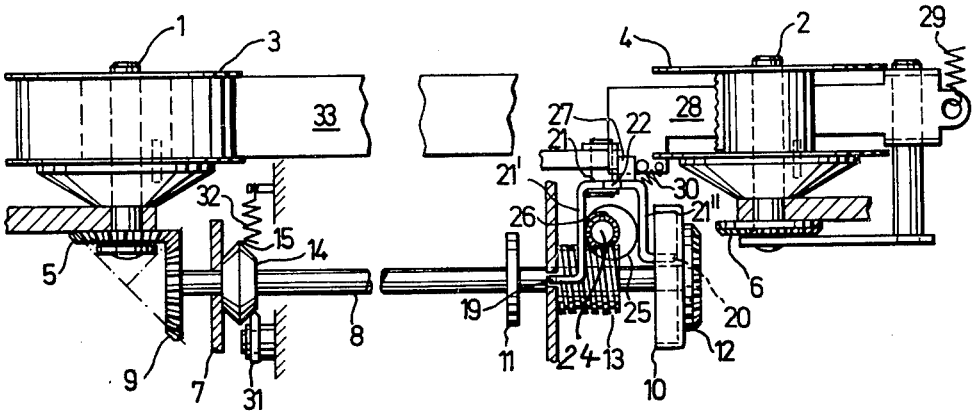
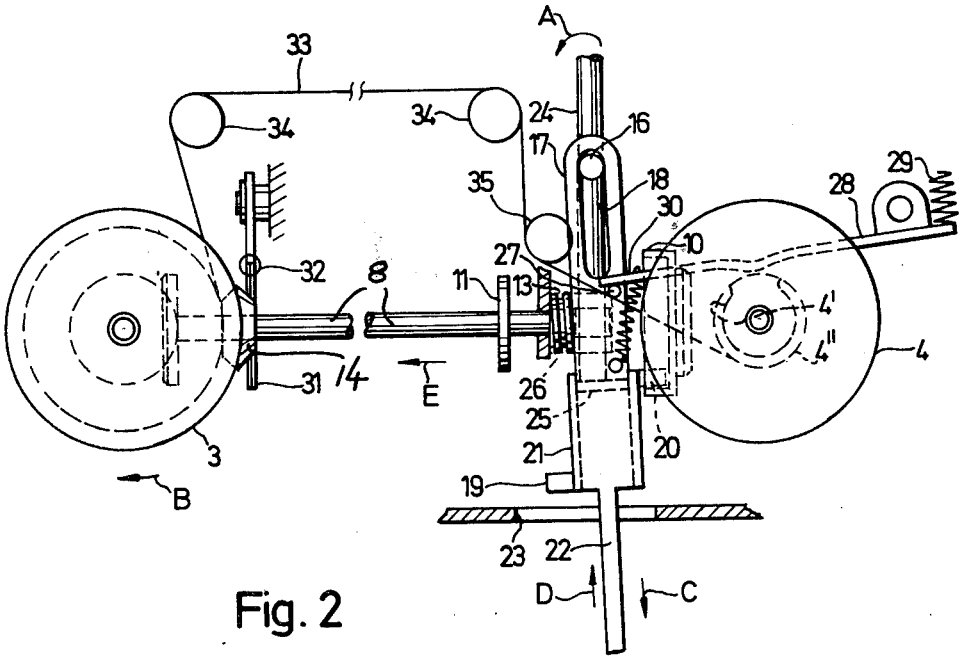
Fig. 2

REVERSING DEVICE FOR THE LONGITUDINAL ADVANCE OF A RIBBON OF TYPE PRINTERS

There is known a reversing device for the longitudinal advance of a ribbon of type printers for the alternate drive of two reels by means of an advancing shaft which is selectively drivingly connected to driving gears respectively provided on each of the reels (U.S. Pat. No. 2,742,132). The reversible drive of the respective winding-up reel to the respective winding-off reel is effected through the intervention of a feeler lever controlled by the ribbon roll or coil, a lever which is displaceable in an oblong hole forming a pivot guiding means and which is influenced by the feeler lever, and an eccentric which rotates synchronously with the advancing shaft.

It is an object of the present invention to provide a reversing device of the above mentioned type which will be independent of the width of the frame and which will be composed of only a few elements.

It is another object of this invention to provide a reversing device as set forth in the preceding paragraph which will make it possible to get by with a single reversing device on one of the reels.

It is still another object of this invention to provide a device as set forth in the two preceding paragraphs in which a coupling of the gears to be brought into driving engagement with each other will be assured and an intermediate positioning error according to which none of the gears drives the ribbon will be avoided.

These and other objects and advantages of the invention will appear more clearly from the following specification in connection with the accompanying drawing, in which:

FIG. 1 illustrates a ribbon reversing device for a printer according to the present invention.

FIG. 2 represents a top view of the reversing device of FIG. 1.

The reversing device according to the present invention which comprises a lever adapted to be controlled by a feeler lever and which also comprises an eccentric rotating synchronously with the advancing shaft is characterized primarily in that the eccentric is arranged on a stationary drive shaft which is continuously drivingly connected to the advancing shaft, and is furthermore characterized in that the displaceable lever is designed as a pendulum lever which is displaceable approximately perpendicularly with regard to the longitudinal axis of the advancing shaft and is pivotable approximately parallelly to the longitudinal axis. The reversing device according to the invention is furthermore characterized in that the pendulum lever comprises a pin engaged by a feeler lever for the longitudinal displacement thereof, and furthermore comprises two abutments which for purposes of reversing the transporting direction selectively engage one of two abutments on the advancing shaft for an axial displacement thereof.

Referring now to the drawing in detail, reels 3 and 4 are connected to shafts 1 and 2 which are stationarily arranged in the frame work. Bevel gears 5, 6 are arranged on shafts 1 and 2 respectively. The bevel gear 5 on the left-hand side of the drawing meshes with a bevel gear 9 which is arranged on a control shaft 8 that is axially displaceable in the frame work 7. Connected to shaft 8 are abutments 10, 11, a bevel gear 12 on the right-hand side with regard to the drawing, a worm wheel 13 and a bevel disc 14 with a sharp circumferential annular edge 15.

A pendulum lever 17 is by means of an oblong hole 18 pivotally and displaceably mounted about a pivot 16 which is stationarily arranged in the frame work. The pendulum lever 17 is provided with a U-shaped yoke 21 which is equipped with abutment noses 19, 20, the yoke 21 being guided through the intervention of ears 22 at the end face in a recess 23. The legs 21', 21'' of the U-shaped yoke 21 engage on the inside an eccentric 25 which is connected to a drive shaft 24 fixedly mounted in the frame work. The drive shaft 24 through the intervention of a worm 26 engages a worm wheel 13 which has a length that corresponds to the displacement stroke of shaft 8.

A feeler lever 28 which is fixedly journalled in the frame work engages a pin 27 on the side of the pendulum lever. Feeler lever 28 is adapted due to the force of a spring 29 to feel or scan the respective diameter of the right-hand roll of the ribbon 24. Between the feeler lever 28 and the pendulum lever 17 there is stretched a spring 30.

A pawl 31 which is pivotable and journalled in the frame work is by means of a spring 32 continuously urged to engage a conical surface of the bevel disc 14.

A ribbon 33 is connected to the reels 3, 4 and is passed over pivots 34, 35 which are fixedly arranged in the frame work and between which the printing of a type is to be effected.

The arrangement as it is illustrated in the drawing, and as can be seen in particular from FIG. 2, is about to effect a reversal of the transport of the ribbon. The shaft 24 which rotates in the direction of the arrow A drives the left-hand reel 3 in the direction of the arrow B while the reel 3 winds up the ribbon 33. The drive of the reel 3 is effected through the intervention of worm 26 and worm wheel 13 and also through the intervention of bevel gears 5, 9.

A recess 4' provided in the hub of the reel 4'' which recess is freed by the ribbon 33 will in response to a further rotation of the reel 4 permit the feeler lever 28 to drop into the recess. In this way it will be evident that the feeler lever 28 displaces the pendulum lever 17 in the direction of the arrow C so that the pendulum lever 17 driven by the eccentric 23 will by its right-hand abutment nose 20 and the pot-shaped abutment 10 displace shaft 8 toward the right. As a result thereof, the bevel gear 12 is coupled with the bevel gear 6, and the reel 4 acting up to that point as winding-off reel will now act as winding-up reel and will wind up the ribbon.

If the bevel gears 6, 12 and 5, 9 are not properly coupled so that their gear heads move upon each other, the annular edge 15 of the bevel gear 14 will assure that the bevel gears 12, 9 will nevertheless through the intervention of the pawl 31, which due to the spring 32 engages the conical surface, be brought into engagement with the bevel gears 6; 5. If due to a recoil or bouncing the old intermeshing should be restored, the operation will during the successive pendulum movements of the pendulum lever 17 be repeated. In this way the pawl 31 will be prevented from remaining on the annular edge 15 and, more specifically, this will be brought about by the continuous uninterrupted rotary movement of the annular edge 15 or control shaft 8.

After the total length of the ribbon 33 has been wound off from its respective reel, the reversal of the ribbon transport is effected by the fact that the pendulum lever 17 displaced by the feeler lever 28 in the direction of the arrow D displaces shaft 8 in the direction of the arrow E by means of the abutment 11 on the side of the shaft whereby the driving connection illustration in FIG. 2 is restored.

It is, of course, to be understood that the present invention is, by no means, limited to the specific showing in the drawing but also comprises any modifications within the scope of the appended claims.

What we claim is:

1. A reversing device for the longitudinal advance of a ribbon on type printers for the alternating drive of two reels, which includes: two stationarily journalled shafts adapted to receive and to be coupled to a reel for receiving and supporting a ribbon, two first gears respectively rotatably connected to said shafts, a feed shaft, two second gears fixedly connected to said feed shaft and operable alternately in response to an axial displacement of said feed shaft in one or the other axial direction thereof to drivingly and alternately selectively engage one and the other one of said second gears, a first lever forming a feeler lever and adapted to be controlled by a ribbon on one of said reels, a second lever controllable by said first lever, a first guiding member in the form of a slot defining element, a second guiding member in the form of a pin and extending into said slot, one of said members forming a part of said second lever and the other member being stationarily arranged, a rotatable shaft journalled stationarily and continuously drivingly connected to said feed shaft, an eccentric keyed to said last mentioned rotatable shaft for rotation therewith, said second lever beng displaceable substantially perpendicularly with regard to the longitudinal axis of said feed shaft and substantially parallelly to the longitudinal axis of said feed shaft by means of the first and second guiding members and said eccentric so as to form a pendulum lever, said pendulum lever comprising a pin engageable by said feeler lever for bringing about a longitudinal movement of said pendulum lever and also comprising two first spaced abutment means, and said feed shaft being provided with two second abutment means, said first abutment means alternately engaging one of said second abutment means for axially and alternately displacing said feed shaft in one and the opposite direction.

2. A device according to claim 1, in which said pendulum lever forms a U-shaped member with two legs arranged opposite to each other and engaging said eccentric, said legs respectively being provided with said first abutment means.

* * * * *